US005902454A

United States Patent [19]

Nelson

[11] Patent Number: 5,902,454

[45] Date of Patent: May 11, 1999

[54] METHOD OF WHITENING LIGNIN-CONTAINING PAPER PULPS

[75] Inventor: Randall B. Nelson, Seattle, Wash.

[73] Assignee: Ciba Specialty Chemicals Corporation, Tarrytown, N.Y.

[21] Appl. No.: 08/766,909

[22] Filed: Dec. 13, 1996

[51] Int. Cl.[6] ..... D21H 11/00; C09B 69/10

[52] U.S. Cl. ..... 162/158; 162/160; 162/183; 8/648; 8/919

[58] Field of Search ..... 162/72, 73, 74, 162/75, 76, 160, 158, 162, 183; 8/648, 919; 252/301.21

[56] References Cited

U.S. PATENT DOCUMENTS

| | | | |
|---|---|---|---|
| 4,093,645 | 6/1978 | Davison et al. | 562/76 |
| 4,216,105 | 8/1980 | Davison et al. | 510/394 |
| 4,339,238 | 7/1982 | Fringeli et al. | 8/527 |
| 4,599,138 | 7/1986 | Lindahl | 162/19 |
| 5,227,022 | 7/1993 | Leonhardt et al. | 162/76 |
| 5,248,389 | 9/1993 | Heimburger et al. | 162/76 |
| 5,266,078 | 11/1993 | Welkener et al. | 8/648 |
| 5,332,471 | 7/1994 | Naddeo et al. | 162/6 |

*Primary Examiner*—Stanley S. Silverman
*Assistant Examiner*—Jose A. Fortuna
*Attorney, Agent, or Firm*—Kevin T. Mansfield

[57] ABSTRACT

A process to increase the whiteness of paper made from a lignin-containing pulp is disclosed which comprises adding to an aqueous slurry comprising a lignin-containing pulp, in the paper making step, an effective amount of a chelating agent to decrease the content of salts of iron and other heavy metals to 100 ppm or less by weight, based on the dry weight of the pulp, or adding to said aqueous slurry an effective amount of a fluorescent whitening agent, or both a) and b).

37 Claims, No Drawings

METHOD OF WHITENING LIGNIN-CONTAINING PAPER PULPS

The present invention relates to a method of whitening lignin-containing pulps for paper. More particularly it teaches the use of and the parameters necessary to allow fluorescent whitening agents to achieve a whitening effect on paper-making pulps that contain significant amounts of lignin.

Numerous processes are known to convert various types of wood, recycled paper and other fibrous raw materials into pulp suitable for making paper. In general these processes can be categorized as mechanical pulping processes, chemical pulping processes and combinations thereof. The properties of the pulp are determined by the raw materials and the processing parameters. Therefore, the end use of the paper will usually dictate both the raw materials to use and suitable processing parameters.

In a chemical pulping process to produce kraft paper, much of the lignin and hemicellulose in the wood employed is removed or solubilized by a series of chemical treatments. To obtain pulp suitable for white paper such as writing paper, additional bleaching steps are necessary which remove most of the remaining lignin. The resulting low lignin or substantially lignin-free papers possess high strength and a brightness of 85% or more. However they are relatively expensive due to the numerous treatment steps, the effluent treatment costs, and the fact that somewhat more than half of the dry weight of the wood is lost during the chemical treatments.

In mechanical pulping processes, such as the refiner mechanical pulp and thermomechanical pulp (TMP) processes, the fibers are separated by a combination of heat and mechanical energy. Such processes produce paper at a lower cost since the treatment costs are reduced, and the yield, based on the dry weight of the wood, is usually about 95% since there is no chemical removal of the wood components. Chemithermomechanical pulp (CTMP) processes, in which some degree of chemical treatment is applied either to the wood chips before thermomechanical pulping or to the pulp after it, and semimechanical pulp (SMP) processes, wherein there is a somewhat greater degree of chemical digestion of the wood chips before thermomechanical pulping, are also employed. The yield, based on the dry weight of the wood, is somewhat reduced by these chemical treatments, since there is some removal of the wood components, but it is still substantially higher than that from a purely chemical pulping process.

Pulps from mechanical processes are bleached, if desired, prior to the paper-making step, with chemicals that do not remove lignin, such as alkaline hydrogen peroxide or sodium dithionite, resulting in paper having a brightness value of up to about 80. In addition to the lower brightness values, paper from a mechanical pulping process has lower light stability, strength and permanence compared to paper prepared from a chemical pulping process. A major market for paper prepared by mechanical pulping processes is paper for newspapers.

For some end uses, paper made from a blend of chemical and mechanical pulps is advantageously employed, and recycled paper usually contains paper made from both chemical and mechanical pulps, but predominantly the latter. Thus the amount of lignin in paper can vary greatly, at one extreme being about the same as that found in the wood chips from which the paper was prepared and, at the other end, being close to zero in high brightness paper prepared from bleached chemical pulps.

For many end uses the color, or more precisely the lack of color of the resulting paper is a critical parameter. It is therefore highly desirable to be able to increase the whiteness or brightness of lignin-containing pulps for paper in a cost-effective manner.

The brightness standard is measured as the reflectance of light in the blue range (457 nm) in comparison to magnesium oxide as 100% white. In the United States brightness is usually measured with the General Electric brightness meter. Thus a GE brightness of 80 corresponds to 80% of the brightness of magnesium oxide, as measured with the GE meter.

The ability to increase the whiteness of lignin-containing pulps for paper, and hence the resulting paper, could provide access to markets from which lower cost papers have previously been excluded. This ability could also be used to offset the limitations of process equipment or to maintain quality despite variability in the raw materials. Thus it would provide paper mill operators with an additional measure of flexibility in meeting the requirements of their customers.

It is well known that paper prepared from chemical pulping processes in combination with bleaching, i.e. substantially lignin-free paper, can be, and usually is, whitened by addition of fluorescent whitening agents, both to the pulping stage and to the preformed sheets as a surface coating. Indeed a number of fluorescent whitening agents are marketed for this express purpose. However, it is also common knowledge that fluorescence is inhibited by lignin. This effect has precluded the use of fluorescent whitening agents in making paper from pulps containing significant amounts of lignin such as those from mechanical pulping processes.

It is also known that chelating agents can be advantageously employed in processes to bleach pulps from mechanical pulping processes. See V. N. Gupta, Pulp Paper Mag. Can., 71 (18), T391–399 (1970). However there is no mention of the use of chelating agents in the subsequent paper-making step.

Surprisingly, it has now been found that it is possible to increase the whiteness of paper made from a lignin-containing pulp by a process which comprises:

a) adding to an aqueous slurry comprising a lignin-containing pulp, in the paper-making step, an effective amount of a chelating agent to decrease the content of salts of iron and other heavy metals to 100 ppm or less by weight, based on the dry weight of the pulp, or b) adding to said pulp an effective amount of a fluorescent whitening agent, or both a) and b).

By "a lignin-containing pulp" is meant any pulp that still contains 5% or more of lignin by weight on a dry basis. By definition, lignin is that portion of the pulp which is insoluble in 72 weight percent sulfuric acid. Suitable test procedures for lignin content are given in TAPPI T 223 and ASTM D 1106.

The process of this invention produces significant whitening of paper from pulps containing from about 5% lignin on a dry weight basis up to 100% of the lignin present in an equivalent amount of wood chips, e.g. thermomechanical pulps. Preferably the pulps contain at least 10% of lignin by weight on a dry weight basis; most preferably they contain at least 15%.

The addition of a chelating agent to an aqueous pulp slurry results in the conversion of iron and other heavy metals such as copper, zinc and manganese, and their ions into the form of their highly soluble chelates. This decreases the incorporation of said heavy metal ions into the paper. Additionally the chelating agent sequesters the salts of iron and other heavy metals which remain and which, in their own right would otherwise relax the excited state of fluorescent whiteners and render them ineffective.

All types of chelating agents are suitable in the present invention, i.e. those that offer thermodynamic or kinetic control of metal ions. However preference is given to chelating agents that offer thermodynamic control, that is, chelating agents that form a stable, isolable, complex with a heavy metal ion. Within this group it is particularly preferred to use aminocarboxylic acid chelates. Well known and commercially available members of this class include ethylenediaminetetraacetic acid (EDTA), diethylene triaminepentaacetic acid (DTPA), hydroxyethylethylenediaminetriacetic acid (HEDTA) and nitrilotriacetic acid (NTA).

Mixtures of thermodynamic and kinetic controlling chelating agents (e.g. citrates, keto acids, gluconates, heptagluconates, phosphates, and phosphonates) also work well in reducing the content of free heavy metal ions in the paper to acceptable levels. Kinetic controlling chelating agents are those which do not form a stable, isolable, complex with a heavy metal ion.

The amount of chelating agent to employ will vary with the heavy metal content of the aqueous pulping slurry and the degree of whiteness improvement desired. In some cases only a chelating agent is required to achieve the desired brightness and no fluorescence is required. Therefore no fluorescent whitening agent is added.

The background level of residual iron and other heavy metals and their ions in wood chips is generally about 10–25 ppm, although it is rather dependent on geography and species considerations. The amount of iron and other heavy metals and their ions in the water used in paper mills varies widely. Significant additional amounts of iron and other heavy metals and their ions are introduced during mechanical pulping of wood chips as well as in recycling newsprint. Thus the amount of iron and other heavy metals and their ions in the aqueous pulp at the paper-making stage is typically several hundred parts per million by weight, based on the dry weight of the pulp.

In general there is no advantage to reducing the content of iron and other heavy metals and their ions below the residual background level found in wood chips. However it is important to reduce the content of iron and other heavy metal ions below 100 ppm. A chelating agent is advantageously employed when the aqueous slurry comprising the lignin-containing pulp, in the paper making step, contains 25 to 500 ppm by weight, based on the dry weight of the pulp, of salts of iron and other heavy metals. At the high end of this range the brightness gain is moderated by iron relaxation of the fluorescent whitening agent and dulling of the pulp due to the natural color of the heavy metal salts. Levels of salts of iron and other heavy metals ions of 100 to 400 ppm give the biggest improvement in brightness when the aqueous pulping slurry is treated with a chelating agent in the paper-making stage.

Heavy metal contents can be determined by standard analytical procedures such as atomic absorption spectroscopy or inductively coupled plasma analysis. Once the type and amounts of the various heavy metals are known, the amount of the chelating agent to employ to reach 100 ppm or less, preferably 25 ppm or less, can readily be calculated or determined from tables. It is not harmful to use a small excess. Thus, depending on the heavy metal content of the aqueous pulping slurry, the chelating agent selected and the degree of whiteness improvement desired, from 0.01 up to about 1% by weight, based on the dry weight of the pulp, of a chelating agent may be advantageously employed. Preferably from 0.02 to 0.5% is used; most preferably 0.03 to 0.25% is used.

Fluorescent whitening agents are substances that absorb light in the invisible ultraviolet region of the spectrum and reemit it in the visible portion of the spectrum, particularly in the blue to blue violet wavelengths. This provides added brightness and can offset the natural yellow cast of a substrate such as paper.

The fluorescent whitening agent used in the present invention may be selected from a wide range of chemical types such as 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides.

Preferred 4,4'-bis-(triazinylamino)-stilbene-2,2'-disulfonic acids are those having the formula:

(1)

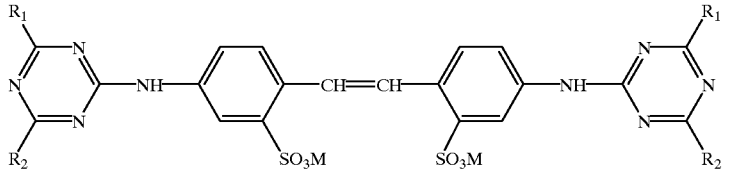

in which $R_1$ and $R_2$, independently, are phenyl, mono- or disulfonated phenyl, phenylamino, mono- or disulfonated phenylamino, morpholino, —$N(CH_2CH_2OH)_2$, —$N(CH_3)(CH_2CH_2OH)$, —$NH_2$, —$N(C_1–C_4alkyl)_2$, —$OCH_3$, —Cl, —NH—$CH_2CH_2SO_3H$, $CH_2CH_2OH$ or ethanolaminopropionic acid amide; and M is H, Na, Li, K, Ca, Mg, ammonium, or ammonium that is mono-, di-, tri- or tetra-substituted by $C_1$–$C_4$alkyl, $C_1$–$C_4$hydroxyalkyl or a mixture thereof. Preferably M is Na, Li or K.

Especially preferred compounds of formula (1) are those in which each $R_1$ is 2,5-disulfophenyl and each $R_2$ is morpholino, —$N(C_2H_5)_2$, —$N(CH_2CH_2OH)_2$ or ethanolaminopropionic acid amide; or each $R_1$ is 3-sulfophenyl and each $R_2$ is $NH(CH_2CH_2OH)$ or $N(CH_2CH_2OH)_2$; or each $R_1$ is 4-sulfophenyl and each $R_2$ is $N(CH_2CH_2OH)_2$, $N(CH_2CHOHCH_3)_2$, morpholino, or ethanolaminopropionic acid amide; or each $R_1$ is phenylamino and each $R_2$ is morpholino, $NH(CH_2CH_2OH)$, $N(CH_2CH_2OH)CH_3$, $N(CH_2CH_2OH)_2$ or ethanolaminopropionic acid amide, and, in each case, the sulfo group is $SO_3M$ in which M is sodium.

The compounds of the formulae (1a)

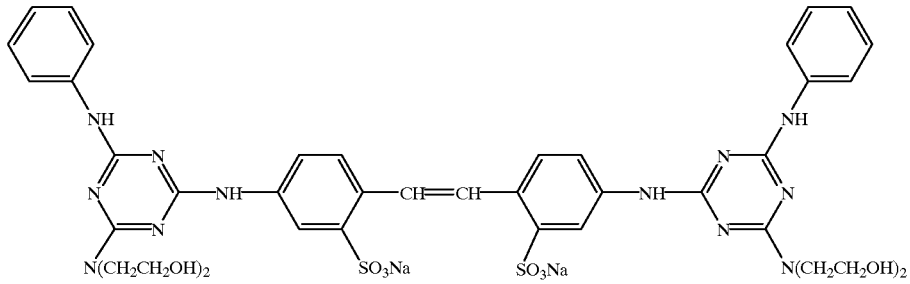

and (1b)

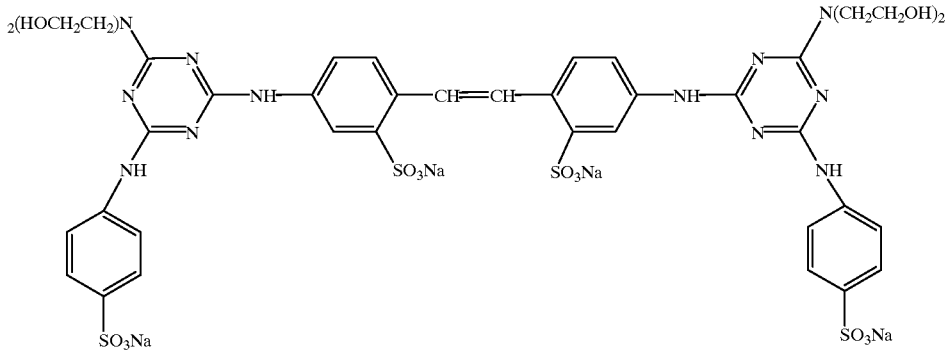

are particularly especially preferred.

Preferred 4,4'-bis-(triazol-2-yl)stilbene-2,2'-disulfonic acids are those having the formula:

(2)

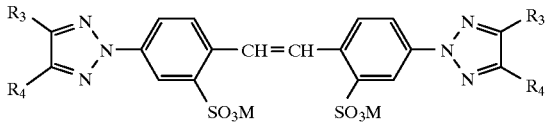

in which $R_3$ and $R_4$, independently, are H, $C_1$–$C_4$alkyl, phenyl or monosulfonated phenyl; and M is H, Na, Li, K, Ca, Mg, ammonium, or ammonium that is mono-, di-, tri- or tetra-substituted by $C_1$–$C_4$alkyl, $C_1$–$C_4$-hydroxyalkyl or a mixture thereof. Preferably M is Na, Li or K.

Especially preferred compounds of formula (2) are those in which $R_3$ is phenyl, $R_4$ is H and M is sodium.

Preferred 4,4'-dibenzofuranyl-biphenyls are those of the formula:

(3)

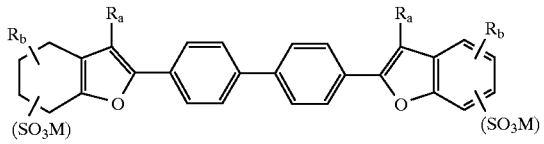

in which $R_a$ and $R_b$, independently, are H or $C_1$–$C_4$alkyl, and M is H, Na, Li, K, Ca, Mg, ammonium, or ammonium that is mono-, di-, tri- or tetra-substituted by $C_1$–$C_4$alkyl, $C_1$–$C_4$-hydroxyalkyl or a mixture thereof. Preferably M is Na, Li or K.

Especially preferred is the compound of the formula:

(3a)

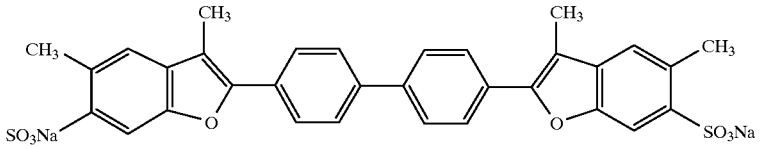

Preferably, the 4,4'-distyryl-biphenyls used are those of the formula:

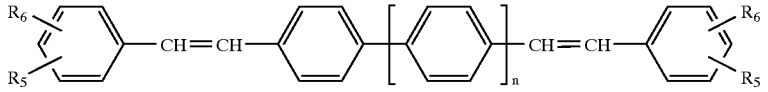

(4)

in which $R_5$ and $R_6$, independently, are H, $SO_3M$, $SO_2N(C_1-C_4alkyl)_2$, O—($C_1$–$C_4$alkyl), CN, Cl, COO($C_1$–$C_4$alkyl), CON($C_1$–$C_4$alkyl)$_2$ or $O(CH_2)_3N^{\oplus}(CH_3)_2An^-$, in which M is H, Na, Li, K, Ca, Mg, ammonium, or ammonium that is mono-, di-, tri- or tetra-substituted by $C_1$–$C_4$alkyl, $C_1$–$C_4$-hydroxyalkyl or a mixture thereof, $An^-$ is an anion of an organic or inorganic acid or a mixture thereof, and n is 1. Preferably M is Na, Li or K and $An^-$ is a formate, acetate, propionate, glcolate, lactate, acrylate, methanephosphonate, phosphite, dimethyl or diethyl phosphite anion, or a mixture thereof.

Especially preferred compounds of formula (4) are those in which each $R_6$ is H, each $R_5$ is a 2-$SO_3M$ group in which M is sodium or each $R_5$ is $O(CH_2)_3N^{\oplus}(CH_3)_2An^-$, in which $An^-$ is acetate.

Preferred 4-phenyl-4'-benzoxazolyl-stilbenes have the formula:

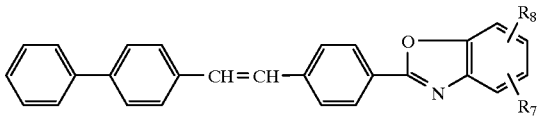

(5)

in which $R_7$ and $R_8$, independently, are H, Cl, $C_1$–$C_4$alkyl or $SO_2$—$C_1$–$C_4$alkyl.

Preferably, the stilbenyl-naphthotriazoles used are those of the formula:

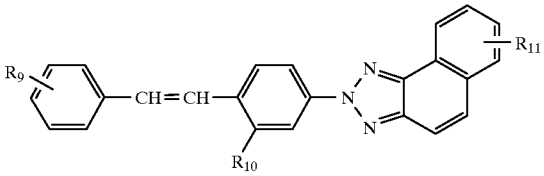

(6)

in which $R_9$ is H or Cl; $R_{10}$ is $SO_3M$, $SO_2N(C_1-C_4alkyl)_2$, $SO_2O$-phenyl or CN; $R_{11}$ is H or $SO_3M$; and M is H, Na, Li, K, Ca, Mg, ammonium, or ammonium that is mono-, di-, tri- or tetra-substituted by $C_1$–$C_4$alkyl, $C_1$–$C_4$hydroxyalkyl or a mixture thereof. Preferably M is Na, Li or K.

Especially preferred compounds of formula (6) are those in which $R_9$ and $R_{11}$ are H and $R_{10}$ is 2-$SO_3M$ in which M is Na.

Preferably, the 4-styryl-stilbenes used are those of the formula:

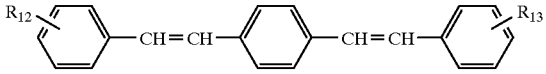

(7)

in which $R_{12}$ and $R_{13}$, independently, are H, $SO_3M$, $SO_2N(C_1-C_4alkyl)_2$, O—($C_1$–$C_4$alkyl), CN, Cl, COO($C_1$–$C_4$alkyl), CON($C_1$–$C_4$alkyl)$_2$ or $O(CH_2)_3N^{\oplus}(CH_3)_2An^-$ in which $An^-$ is an anion of an organic or inorganic acid, in particular a formate, acetate, propionate, glcolate, lactate, acrylate, methanephosphonate, phosphite, dimethyl or diethyl phosphite anion, or a mixture thereof and M is H, Na, Li, K, Ca, Mg, ammonium, or ammonium that is mono-, di-, tri- or tetra-substituted by $C_1$–$C_4$alkyl, $C_1$–$C_4$hydroxyalkyl or a mixture thereof. Preferably M is Na, Li or K.

Especially preferred compounds of formula (7) are those in which each of $R_{12}$ and $R_{13}$ is 2-cyano or 2-$SO_3M$ in which M is sodium or $O(CH_2)_3N^{\oplus}(CH_3)_2An^-$ in which $An^-$ is acetate.

Preferred bis-(benzoxazol-2-yl) derivatives are those of the formula:

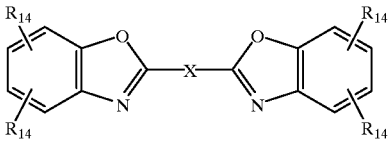

(8)

in which $R_{14}$, independently, is H, $C(CH_3)_3$, $C(CH_3)_2$-phenyl, $C_1$–$C_4$alkyl or COO—$C_1$–$C_4$alkyl, and X is —CH═CH— or a group of the formula:

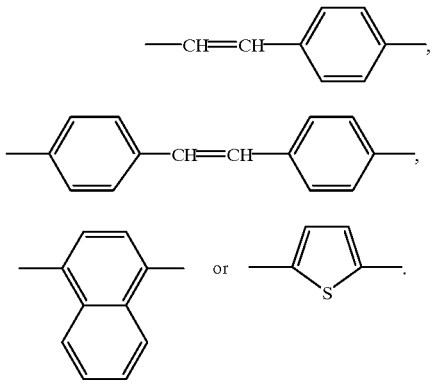

Especially preferred compounds of formula (8) are those in which each $R_{14}$ is H and X is

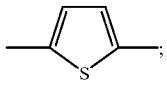

or one group $R_{14}$ in each ring is 2-methyl and the other $R_{14}$ is H and X is —CH═CH—; or one group $R_{14}$ in each ring is 2-$C(CH_3)_3$ and the other $R_{14}$ is H and X is

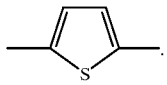

Preferred bis-(benzimidazol-2-yl) derivatives are those of the formula:

(9)

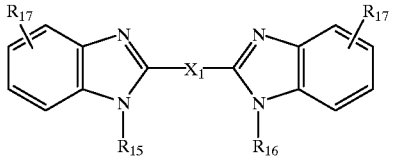

in which $R_{15}$ and $R_{16}$, independently, are H, $C_1$–$C_4$alkyl or $CH_2CH_2OH$; $R_{17}$ is H or $SO_3M$; $X_1$ is —CH═CH— or a group of the formula:

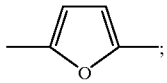

and M is H, Na, Li, K, Ca, Mg, ammonium, or ammonium that is mono-, di-, tri- or tetra-substituted by $C_1$–$C_4$alkyl, $C_1$–$C_4$hydroxyalkyl or a mixture thereof. Preferably M is Na, Li or K.

Especially preferred compounds of formula (9) are those in which $R_{15}$ and $R_{16}$ are each H, $R_{17}$ is $SO_3M$ in which M is sodium and $X_1$ is —CH═CH—.

Preferred coumarins are those of the formula:

(10)

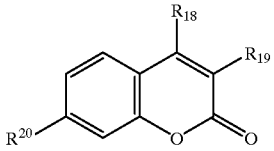

in which $R_{18}$ is H, Cl or $CH_2COOH$, $R_{19}$ is H, phenyl, COO—$C_1$–$C_4$alkyl or a group of the formula:

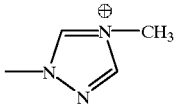

and $R_{20}$ is O—$C_1$–$C_4$alkyl, $N(C_1$–$C_4alkyl)_2$, NH—CO—$C_1$–$C_4$alkyl or a group of the formula:

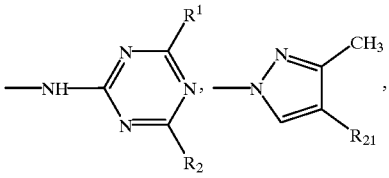

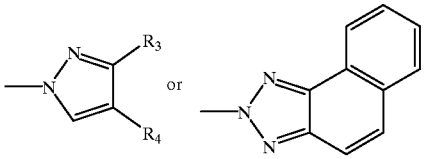

in which $R_1$ and $R_2$, independently, are phenyl, mono- or disulfonated phenyl, phenylamino, mono- or disulfonated phenylamino, morpholino, —$N(CH_2CH_2OH)_2$, —$N(CH_3)(CH_2CH_2OH)$, —$NH_2$, —$N(C_1$–$C_4alkyl)_2$, —$OCH_3$, —Cl, —NH—$CH_2CH_2SO_3H$ or —NH—$CH_2CH_2OH$, $R_3$ and $R_4$, independently, are H, $C_1$–$C_4$alkyl, phenyl or monosulfonated phenyl and $R_{21}$ is H, $C_1$–$C_4$alkyl or phenyl.

Especially preferred compounds of formula (10) are those having the formula:

(11)

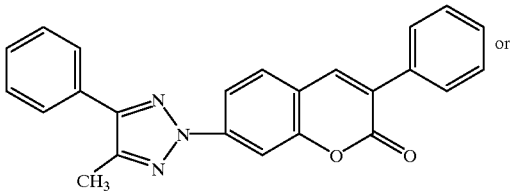

(12)

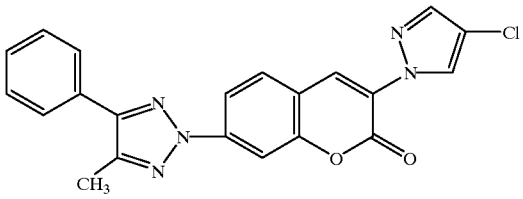

Preferably, the pyrazolines used are those having the formula:

(13)

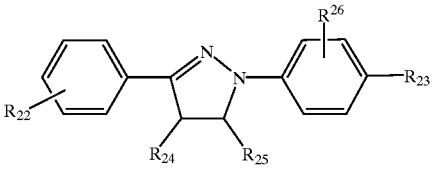

in which $R_{22}$ is H, Cl or $N(C_1$–$C_4alkyl)_2$, $R_{23}$ is H, Cl, $SO_3M$, $SO_2NH_2$, $SO_2NH$—$(C_1$–$C_4alkyl)$, COO—$C_1$–$C_4$alkyl, $SO_2$—$C_1$–$C_4$alkyl, $SO_2NHCH_2CH_2CH_2N^{\oplus}(CH_3)_3$ or $SO_2CH_2CH_2N^{\oplus}H(C_1$–$C_4alkyl)_2$ $An^-$, $R_{24}$ and $R_{25}$ are the same or different and each is H, $C_1$–$C_4$alkyl or phenyl, $R_{26}$ is H or Cl, $An^-$ is an anion of an organic or inorganic acid, and M is H, Na, Li, K, Ca, Mg, ammonium, or ammonium that is mono-, di-, tri- or tetra-substituted by $C_1$–$C_4$alkyl, $C_1$–$C_4$hydroxyalkyl or a mixture thereof. Preferably M is Na, Li or K.

Especially preferred compounds of formula (13) are those in which $R_{22}$ is Cl, $R_{23}$ is $SO_2CH_2CH_2N^{\oplus}H(C_1–C_4alkyl)_2An^-$ in which $An^-$ is phosphite and $R_{24}$, $R_{25}$ and $R_{26}$ are each H; or those having the formula:

(14)

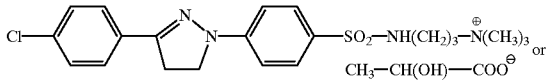

(15)

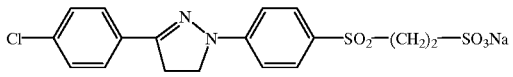

Preferred naphthalimides are those of the formula:

(16)

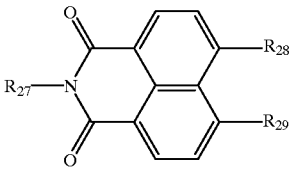

in which $R_{27}$ is $C_1$–$C_4$alkyl or $CH_2CH_2CH_2N^{\oplus}(CH_3)_3An^-$ in which $An^-$ is an anion of an organic or inorganic acid, $R_{28}$ and $R_{29}$, independently, are O—$C_1$–$C_4$-alkyl, $SO_3M$ or NH—CO—$C_1$–$C_4$alkyl; and M is H, Na, Li, K, Ca, Mg, ammonium, or ammonium that is mono-, di-, tri- or tetra-substituted by $C_1$–$C_4$alkyl, $C_1$–$C_4$hydroxyalkyl or a mixture thereof. Preferably M is Na, Li or K.

Especially preferred compounds of formula (16) are those having the formula:

(17)

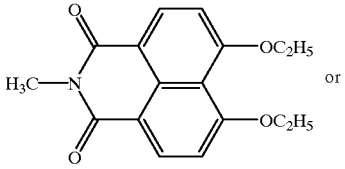

(18)

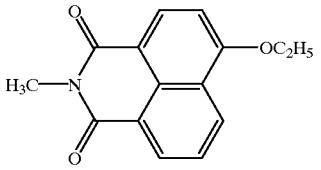

Preferred 2-styryl-benzoxazole- or -naphthoxazole derivatives are those having the formula:

(20)

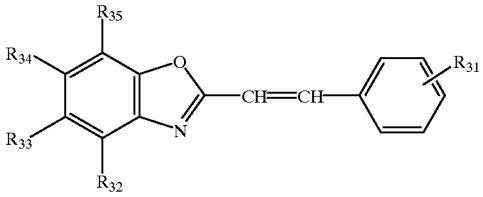

in which $R_{31}$ is CN, Cl, COO—$C_1$–$C_4$alkyl or phenyl; $R_{32}$ and $R_{33}$ are the atoms required to form a fused benzene ring or $R_{33}$ and $R_{35}$, independently, are H or $C_1$–$C_4$alkyl; and $R_{34}$ is H, $C_1$–$C_4$alkyl or phenyl.

Preferred benzimidazole-benzofuran derivatives are those having the formula:

(21)

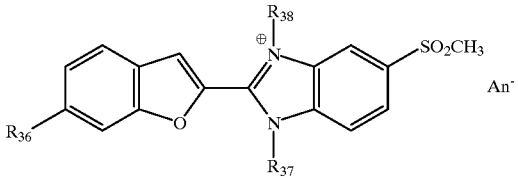

in which $R_{36}$ is $C_1$–$C_4$alkoxy; $R_{37}$ and $R_{38}$, independently, are $C_1$–$C_4$alkyl; and $An^-$ is an anion of an organic or inorganic acid.

A particularly preferred compound of formula (21) is that in which $R_{36}$ is methoxy, $R_{37}$ and $R_{38}$ are each methyl and $An^-$ is methane sulfonate.

Preferred oxanilide derivatives include those having the formula:

(22)

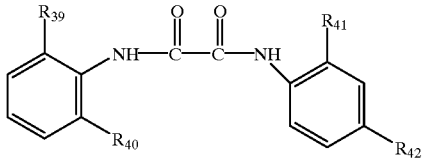

in which $R_{39}$ is $C_1$–$C_4$alkoxy, $R_{41}$ is $C_1$–$C_4$alkyl, $C_1$–$C_4$alkyl-$SO_3M$ or $C_1$–$C_4$alkoxy-$SO_3M$ in which M is H, Na, Li, K, Ca, Mg, ammonium, or ammonium that is mono-, di-, tri- or tetra-substituted by $C_1$–$C_4$alkyl, $C_1$–$C_4$hydroxyalkyl or a mixture thereof, preferably Na, Li or K, and $R_{40}$ and $R_{42}$ are the same and each is hydrogen, tert. butyl or $SO_3M$, in which M is as defined for $R_{41}$.

Compounds of the above formulae are known per se and can be prepared by known methods.

In the above classes of fluorescent whitening agents, it is advantageous to employ those that have a high affinity for the cellulosic or lignin portion of the pulp fibers. A particularly preferred group of such fluorescent whitening agents are those that are substituted by sulfonic acid groups, especially 2 to 6 sulfonic acid groups. It is especially preferred to employ those that have 2 sulfonic acid groups as the primary fluorescent whitening agents.

It is noted that fluorescent whitening agents may exhibit a green or bluish cast at high dosage levels, e.g. at dosage levels of about 2% by weight, based on the dry weight of the pulp. This is a normal expected effect and is unchanged by the presence of a metal chelating agent. This can be counteracted by the use of appropriate levels of mixtures of fluorescent whitening agents, particularly mixtures which contain fluorescent whitening agents having a more reddish cast.

A preferred aspect of the present invention is to extend the effectiveness of the primary fluorescent brightener, in particular a fluorescent whitening agent that has 2 sulfonic acid groups, with a more highly active and lower affinity whitener such as a fluorescent whitening agent that has 4 or 6 sulfonic acid groups. This allows the tailoring of the brightener mix to optimize the development of fluorescence and shade, as well as the economics of the process. Use of a mixture of the fluorescent whitening agents of the formulae (1a) and (1b) is particularly referred in this regard.

The amount of the fluorescent whitening agent to employ will vary from 0.01 up to about 2% by weight, based on the dry weight of the pulp, depending on the degree of whiteness improvement desired. Preferably from 0.05 to 1.5% is used; most preferably 0.1 to 1% is used.

Prior to forming paper, a pulp is subjected to a series of chemical treatments and extractions. In the process of the present invention, even if a chelating agent was employed in an earlier step, for example during bleaching, it is still important to supply additional chelating agent to a lignin-containing pulp in the paper-making step to control the amount of salts of iron and other heavy metals within the ranges taught above. Advantageously, the fluorescent whitening agent is added in this same step to minimize physical and chemical losses.

Additives which are known to enhance the effectiveness of fluorescent whitening agents may also be used in the present invention. Thus another preferred aspect of the present invention comprises using a fluorescent whitening agent in combination with an additive, for example a substance used to promote UV absorption and "bloom" of the fluorescent whitener in paper or a material that effectively allows the optical brightener to develop a higher degree of fluorescent whitening by cleaning the pulp fibers. Suitable additives include cationic starch, polyvinyl alcohol and enzymes. Suitable enzymes include cellulases and hemicellulases. Use of polyvinyl alcohol is particularly preferred. For example, addition of polyvinyl alcohol to the pulp at the 1.25% level, based on the dry weight of the pulp, can increase the effectiveness of the optical brightener by up to four more GE units in the resulting paper, compared to non-promoter-enhanced use of the same fluorescent whitening agent.

In the following illustrative Examples, parts are parts by weight.

EXAMPLE 1

To an aqueous slurry containing about 1.1% of deinked, recycled newsprint pulp based on the dry weight of the pulp, i.e. a bleached thermomechanical pulp having an iron content of about 200 ppm and a lignin content which typically corresponds to 85–90% of the lignin present in an equivalent amount of wood chips, is added, in separate streams, 0.48 parts of a 41% solution of diethylenetriaminepentaacetic acid (DTPA) and 0.78 parts of a liquid containing 12.5% by weight of the fluorescent whitening agent of the formula (1a)

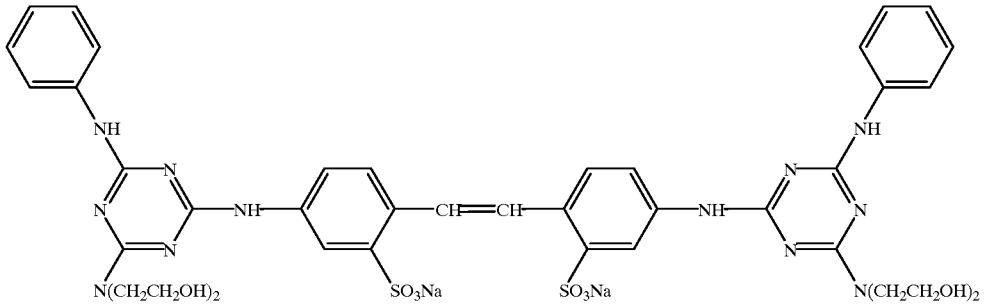

per 100 parts of the pulp slurry, both based on the "as is" weight of the pulp slurry. As a result of these additions, the brightness of the resulting paper rises from its initial value of 67 to 74. Of this, 0.5 to 1.75 points of the rise is attributable to the presence of the chelating agent; the remainder to the fluorescent whitening agent.

EXAMPLE 2

Example 1 is repeated, but using an aqueous slurry containing about 1.1% of a 60:40 mixture of a bleached thermomechanical pulp and a deinked, recycled newsprint pulp and adding 0.40 parts of a 41% solution of diethylenetriaminepentaacetic acid (DTPA) per 100 parts of the pulp slurry to it. Various fluorescent whitening agents and amounts are used. With 0.1 to 0.74 parts of a liquid containing 12.5% by weight of the fluorescent whitening agent of the formula (1a)

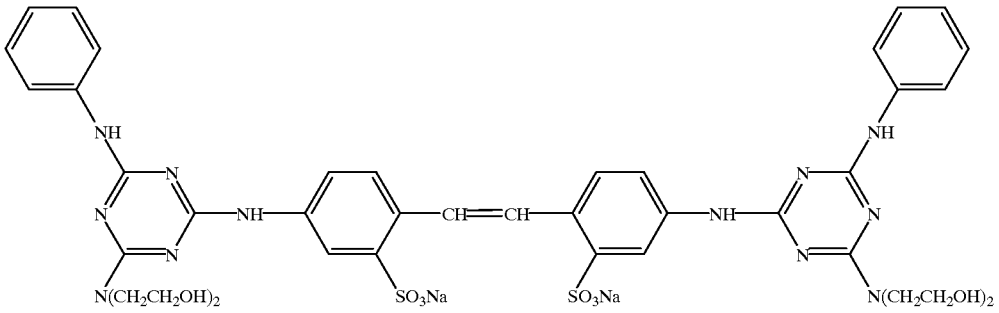

the brightness rises and stabilizes in a relatively short time. When this brightener is replaced by an aqueous solution of containing 26% by weight of the tetrasulfo fluorescent whitening agent of the formula:

(Ib)

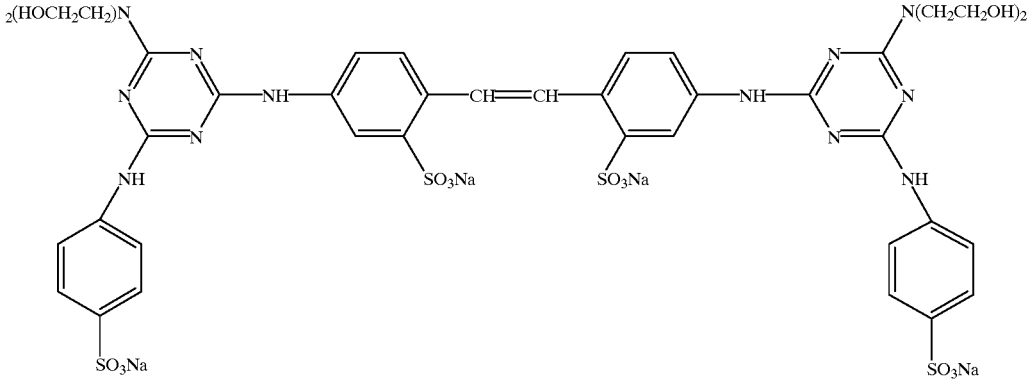

the initial whitening effect is smaller. Due to its lower affinity for the pulp, a significant amount of this brightener is removed in the white water. However, by recycling the white water back into the process, there is a noticeable improvement in the brightness of the incoming pulp and overall good results are obtained.

It is advantageous to employ brightener mixtures, e.g. using a fixed amount of the tetrasulfo fluorescent whitening agent of the formula (1b) to establish baseline performance, and to vary the amount of the fluorescent whitening agent of the formula (1a) in quick response to variations in the brightness of the incoming pulp.

What is claimed is:

1. A process to increase the whiteness of paper made from a pulp which contains 5% or more of lignin on a dry basis which comprises:

a) adding to an aqueous slurry comprising said lignin-containing pulp, in a paper making step, an effective amount of a chelating agent to decrease the content of salts of iron and other heavy metals to 100 ppm or less by weight, based on the dry weight of the pulp, or b) adding to said aqueous slurry an effective whitening amount of a fluorescent whitening agent, or both a) and b).

2. A process according to claim 1, wherein both a chelating agent and a fluorescent whitening agent are added to the pulp.

3. A process according to claim 1, wherein the pulp contains 10% or more of lignin on a dry basis.

4. A process according to claim 1, wherein a chelating agent is present which is selected from those that effect thermodynamic control of metal ions.

5. A process according to claim 4, wherein the chelating agent is selected from the group consisting of ethylenediaminetetraacetic acid, diethylene triaminepentaacetic acid, hydroxyethylethylenediaminetriacetic acid and nitrilotriacetic acid.

6. A process according to claim 4, wherein the chelating agent comprises a mixture of thermodynamic and kinetic controlling chelating agents.

7. A process according to claim 1, wherein, in the paper making step, the aqueous slurry comprising a lignin-containing pulp contains 25 to 500 ppm by weight, based on the dry weight of the pulp, of salts of iron and other heavy metals.

8. A process according to claim 7, wherein the aqueous slurry contains 100 to 400 ppm by weight, based on the dry weight of the pulp, of salts of iron and other heavy metals.

9. A process according to claim 1, which comprises adding to the aqueous slurry comprising a lignin-containing pulp, in the paper making step, from 0.01 up to about 1% by weight, based on the dry weight of the pulp, of a chelating agent.

10. A process according to claim 1, wherein the fluorescent whitening agent contains 2 to 6 sulfonic acid groups.

11. A process according to claim 10, wherein the fluorescent whitening agent contains 2 sulfonic acid groups.

12. A process according to claim 1, wherein the fluorescent whitening agent comprises a mixture of a fluorescent whitening agent which contains 2 sulfonic acid groups and a fluorescent whitening agent which contains 4 or 6 sulfonic acid groups.

13. A process according to claim 12, wherein the fluorescent whitening agent comprises a mixture of the compounds of the formulae (1a)

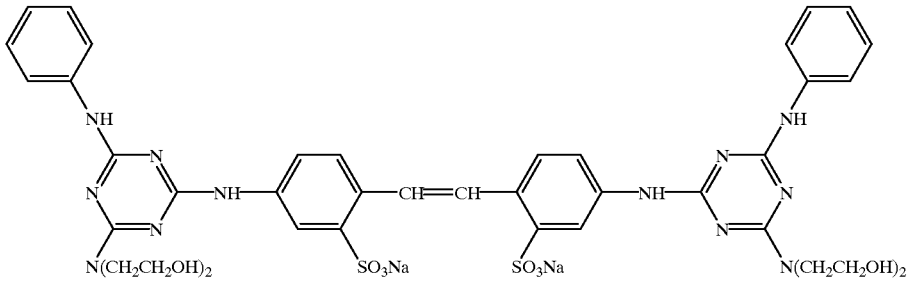

and (1b)

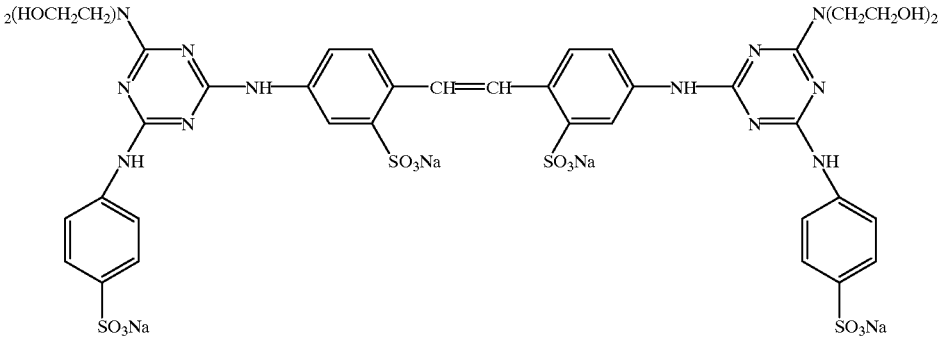

14. A process according to claim 1, wherein from 0.01 up to about 2% by weight, based on the dry weight of the pulp, of fluorescent whitening agent is employed.

15. A process according to claim 1, wherein a fluorescent whitening agent and a fluorescent whitening agent enhancer are added.

16. A process according to claim 15, wherein the additive is cationic starch, polyvinyl alcohol or an enzyme.

(1)

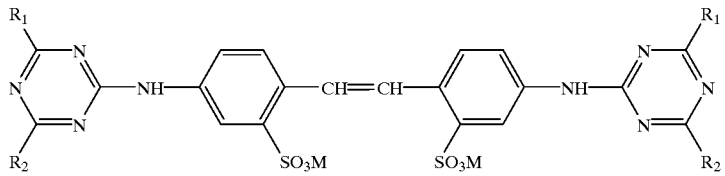

17. A process according to claim 1, wherein the fluorescent whitening agent is selected from the group consisting of 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenyl-naphtho triazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans and oxanilides.

18. A process according to claim 17, wherein the 4,4'-bis-(triazinylamino)-stilbene-2,2'-disulfonic acid fluorescent whitening agent is of the formula:

in which $R_1$ and $R_2$, independently, are phenyl, mono- or disulfonated phenyl, phenylamino, mono- or disulfonated phenylamino, morpholino, —$N(CH_2CH_2OH)_2$, —$N(CH_3)(CH_2CH_2OH)$, —$NH_2$, —$N(C_1–C_4alkyl)_2$, —$OCH_3$, —Cl, —NH—$CH_2CH_2SO_3H$, $CH_2CH_2OH$ or ethanolaminopropionic acid amide; and M is H, Na, Li, K, Ca, Mg, ammonium, or ammonium that is mono-, di-, tri- or tetra-substituted by $C_1$–$C_4$alkyl, $C_1$–$C_4$hydroxyalkyl or a mixture thereof.

19. A process according to claim 18, wherein the fluorescent whitening agent is of the formula (1) in which each $R_1$ is 2,5-disulfophenyl and each $R_2$ is morpholino, —$N(C_2H_5)_2$, —$N(CH_2CH_2OH)_2$ or ethanolaminopropionic acid amide; or each $R_1$ is 3-sulfophenyl and each $R_2$ is $NH(CH_2CH_2OH)$ or $N(CH_2CH_2OH)_2$; or each $R_1$ is 4-sulfophenyl and each $R_2$ is $N(CH_2CH_2OH)_2$, $N(CH_2CHOHCH_3)_2$, morpholino, or ethanolaminopropionic acid amide; or each $R_1$ is phenylamino and each $R_2$ is morpholino, $NH(CH_2CH_2OH)$, $N(CH_2CH_2OH)CH_3$, $N(CH_2CH_2OH)_2$ or ethanolaminopropionic acid amide, and, in each case, the sulfo group is $SO_3M$ in which M is sodium.

20. A process according to claim 19, wherein the fluorescent whitening agent is of the formula

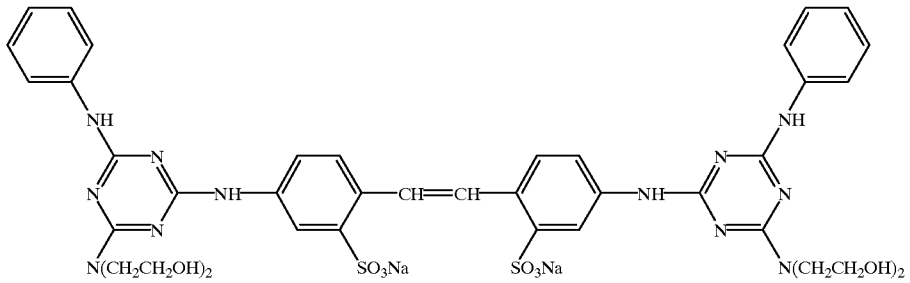

(1a)

or

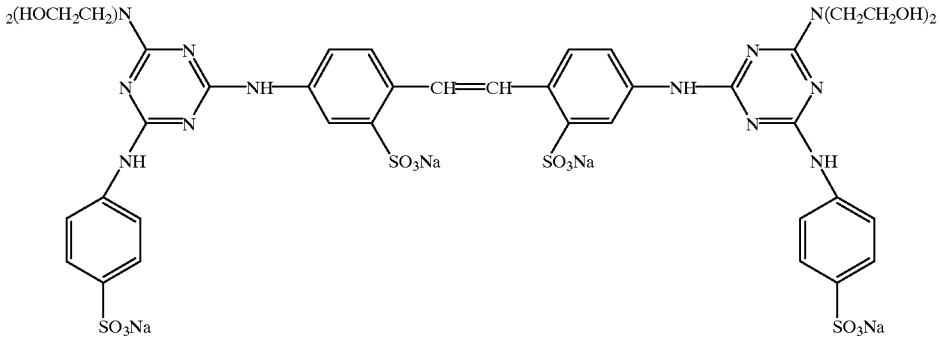

(1b)

21. A process according to claim 17, wherein the 4,4'-bis-(triazol-2-yl)stilbene-2,2'-disulfonic acid fluorescent whitening agent is of the formula:

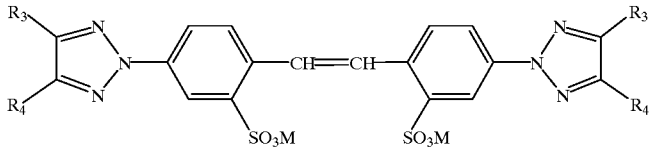

(2)

in which $R_3$ and $R_4$, independently, are H, $C_1$–$C_4$alkyl, phenyl or monosulfonated phenyl; and M is H, Na, Li, K, Ca, Mg, ammonium, or ammonium that is mono-, di-, tri- or tetra-substituted by $C_1$–$C_4$alkyl, $C_1$–$C_4$-hydroxyalkyl or a mixture thereof.

22. A process according to claim 21, wherein the fluorescent whitening agent is of the formula (2) in which $R_3$ is phenyl, $R_4$ is H and M is sodium.

23. A process according to claim 17, wherein the 4,4'-dibenzofuranyl-biphenyl fluorescent whitening agent is of the formula:

(3)

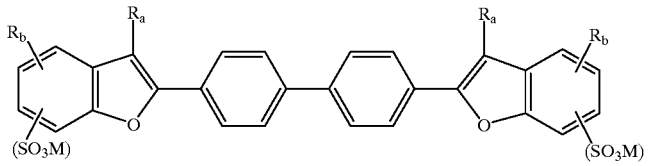

in which $R_a$ and $R_b$, independently, are H or $C_1$–$C_4$alkyl, and M is H, Na, Li, K, Ca, Mg, ammonium, or ammonium that is mono-, di-, tri- or tetra-substituted by $C_1$–$C_4$alkyl, $C_1$–$C_4$-hydroxyalkyl or a mixture thereof.

24. A process according to claim 23, wherein the fluorescent whitening agent is the compound of the formula (3a)

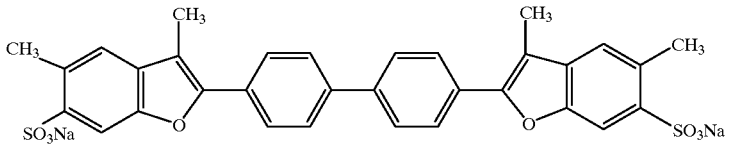

25. A process according to claim 17, wherein the 4,4'-distyryl-biphenyl fluorescent whitening agent is of the formula:

(4)

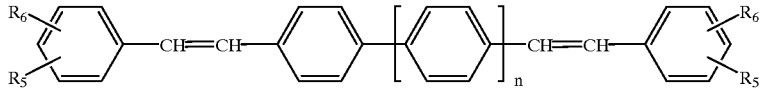

in which $R_5$ and $R_6$, independently, are H, $SO_3M$, $SO_2N(C_1$–$C_4alkyl)_2$, O—($C_1$–$C_4$alkyl), CN, Cl, COO($C_1$–$C_4$alkyl), CON($C_1$–$C_4$alkyl)$_2$ or $O(CH_2)_3N^{\oplus}(CH_3)_2An^-$, in which M is H, Na, Li, K, Ca, Mg, ammonium, or ammonium that is mono-, di-, tri- or tetra-substituted by $C_1$–$C_4$alkyl, $C_1$–$C_4$-hydroxyalkyl or a mixture thereof, $An^-$ is an anion of an organic or inorganic acid or a mixture thereof, and n is 1.

26. A process according to claim 25, wherein the fluorescent whitening agent is of the formula (4) in which each $R_6$ is H and each $R_5$ is a 2-$SO_3M$ group in which M is sodium or each $R_5$ is $O(CH_2)_3N^{\oplus}(CH_3)_2An^-$, in which $An^-$ is acetate.

27. A process according to claim 17, wherein the fluorescent whitening agent is a 4-phenyl-4'-benzoxazolyl-stilbene of the formula:

(5)

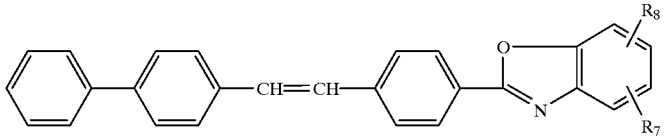

in which $R_7$ and $R_8$, independently, are H, Cl, $C_1$–$C_4$alkyl or $SO_2$—$C_1$–$C_4$alkyl or is a stilbenyl-naphthotriazole of the formula:

(6)

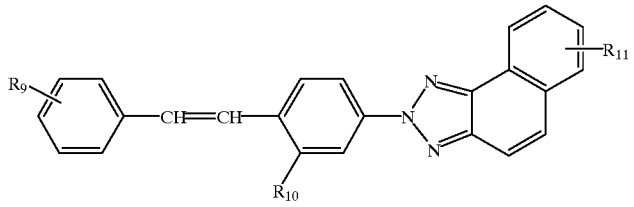

in which $R_9$ is H or Cl; $R_{10}$ is $SO_3M$, $SO_2N(C_1–C_4alkyl)_2$, $SO_2O$-phenyl or CN; $R_{11}$ is H or $SO_3M$; and M is H, Na, Li, K, Ca, Mg, ammonium, or ammonium that is mono-, di-, tri- or tetra-substituted by $C_1–C_4$alkyl, $C_1–C_4$hydroxyalkyl or a mixture thereof.

28. A process according to claim 17, wherein the fluorescent whitening agent is a 4-styryl-stilbene of the formula:

(7)

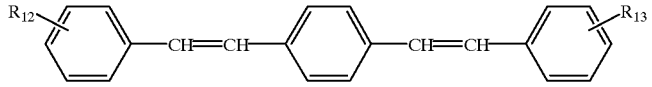

in which $R_{12}$ and $R_{13}$, independently, are H, $SO_3M$, $SO_2N(C_1–C_4alkyl)_2$, O—($C_1–C_4$alkyl), CN, Cl, COO($C_1–C_4$alkyl), CON($C_1–C_4$alkyl)$_2$ or $O(CH_2)_3N^{\oplus}(CH_3)_2An^-$ in which $An^-$ is an anion of an organic or inorganic acid or a mixture thereof and M is H, Na, Li, K, Ca, Mg, ammonium, or ammonium that is mono-, di-, tri- or tetra-substituted by $C_1–C_4$alkyl, $C_1–C_4$hydroxyalkyl or a mixture thereof.

29. A process according to claim 28, wherein the fluorescent whitening agent is of the formula (7) in which each of $R_{12}$ and $R_{13}$ is 2-cyano or 2-$SO_3M$ in which M is sodium or $O(CH_2)_3N^{\oplus}(CH_3)_2An^-$ in which $An^-$ is acetate.

30. A process according to claim 17, wherein the fluorescent whitening agent is a bis-(benzoxazol-2-yl) derivative of the formula:

(8)

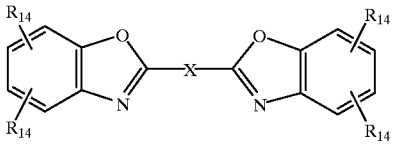

in which $R_{14}$, independently, is H, $C(CH_3)_3$, $C(CH_3)_2$-phenyl, $C_1–C_4$alkyl or COO—$C_1–C_4$alkyl, and X is —CH═CH— or a group of the formula:

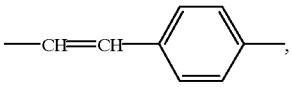

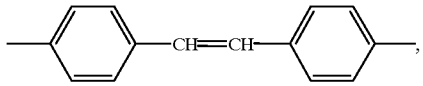

-continued

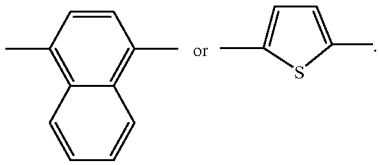

31. A process according to claim 17, wherein the fluorescent whitening agent is a bis-(benzimidazol-2-yl) derivative of the formula:

(9)

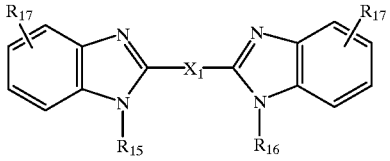

in which $R_{15}$ and $R_{16}$, independently, are H, $C_1–C_4$alkyl or $CH_2CH_2OH$; $R_{17}$ is H or $SO_3M$; $X_1$ is —CH═CH— or a group of the formula:

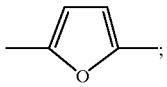

and M is H, Na, Li, K, Ca, Mg, ammonium, or ammonium that is mono-, di-, tri- or tetra-substituted by $C_1–C_4$alkyl, $C_1–C_4$-hydroxyalkyl or a mixture thereof.

32. A process according to claim 17, wherein the fluorescent whitening agent is a coumarin of the formula:

(10)

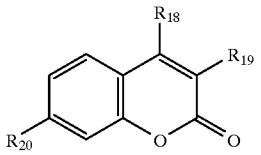

in which $R_{18}$ is H, Cl or $CH_2COOH$, $R_{19}$ is H, phenyl, COO—$C_1$–$C_4$alkyl or a group of the formula:

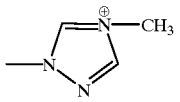

and $R_{20}$ is O—$C_1$–$C_4$alkyl, N($C_1$–$C_4$alkyl)$_2$, NH—CO—$C_1$–$C_4$alkyl or a group of the formula:

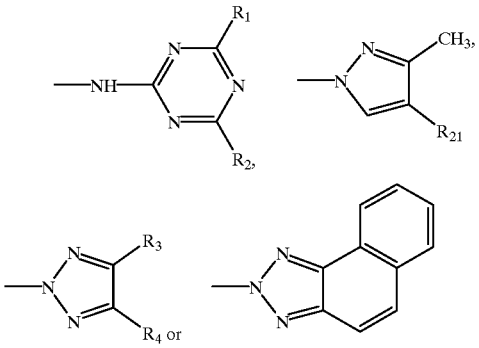

in which $R_1$ and $R_2$, independently, are phenyl, mono- or disulfonated phenyl, phenylamino, mono- or disulfonated phenylamino, morpholino, —N($CH_2CH_2OH$)$_2$, —N($CH_3$)($CH_2CH_2OH$), —$NH_2$, —N($C_1$–$C_4$alkyl)$_2$, —$OCH_3$, —Cl, —NH—$CH_2CH_2SO_3H$ or —NH—$CH_2CH_2OH$, $R_3$ and $R_4$, independently, are H, $C_1$–$C_4$alkyl, phenyl or monosulfonated phenyl and $R_{21}$ is H, $C_1$–$C_4$alkyl or phenyl.

33. A process according to claim 17, wherein the fluorescent whitening agent is a pyrazoline of the formula:

(13)

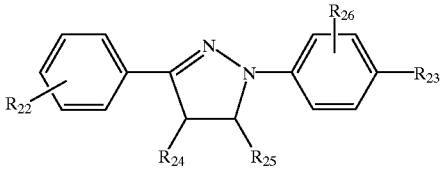

in which $R_{22}$ is H, Cl or N($C_1$–$C_4$alkyl)$_2$, $R_{23}$ is H, Cl, $SO_3M$, $SO_2NH_2$, $SO_2NH$—($C_1$–$C_4$alkyl), COO—$C_1$–$C_4$alkyl, $SO_2$—$C_1$–$C_4$alkyl, $SO_2NHCH_2CH_2CH_2N^{\oplus}(CH_3)_3$ or $SO_2CH_2CH_2N^{\oplus}H(C_1$–$C_4$alkyl$)_2$ $An^-$, $R_{24}$ and $R_{25}$ are the same or different and each is H, $C_1$–$C_4$alkyl or phenyl, $R_{26}$ is H or Cl, $An^-$ is an anion of an organic or inorganic acid, and M is H, Na, Li, K, Ca, Mg, ammonium, or ammonium that is mono-, di-, tri- or tetra-substituted by $C_1$–$C_4$alkyl, $C_1$–$C_4$hydroxyalkyl or a mixture thereof.

34. A process according to claim 17, wherein the fluorescent whitening agent is a naphthalimide of the formula:

(16)

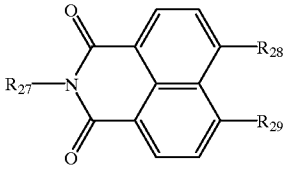

in which $R_{27}$ is $C_1$–$C_4$alkyl or $CH_2CH_2CH_2N^{\oplus}(CH_3)_3An^-$ in which $An^-$ is an anion of an organic or inorganic acid, $R_{28}$ and $R_{29}$, independently, are O—$C_1$–$C_4$-alkyl, $SO_3M$ or NH—CO—$C_1$–$C_4$alkyl; and M is H, Na, Li, K, Ca, Mg, ammonium, or ammonium that is mono-, di-, tri- or tetra-substituted by $C_1$–$C_4$alkyl, $C_1$–$C_4$hydroxyalkyl or a mixture thereof.

35. A process according to claim 17, wherein the fluorescent whitening agent is a 2-styryl-benzoxazole- or -naphthoxazole derivative having the formula:

(20)

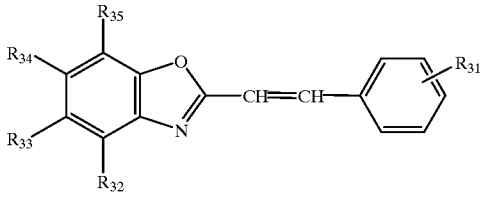

in which $R_{31}$ is CN, Cl, COO—$C_1$–$C_4$alkyl or phenyl; $R_{32}$ and $R_{33}$ are the atoms required to form a fused benzene ring or $R_{33}$ and $R_{35}$, independently, are H or $C_1$–$C_4$alkyl; and $R_{34}$ is H, $C_1$–$C_4$alkyl or phenyl.

36. A process according to claim 17, wherein the fluorescent whitening agent is a benzimidazole-benzofuran derivative having the formula:

(21)

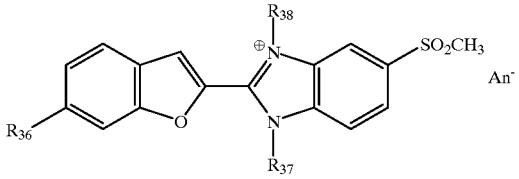

in which $R_{36}$ is $C_1$–$C_4$alkoxy; $R_{37}$ and $R_{38}$, independently, are $C_1$–$C_4$alkyl; and $An^-$ is an anion of an organic or inorganic acid.

37. A process according to claim 10, wherein the fluorescent whitening agent is an oxanilide derivative having the formula:

(22)

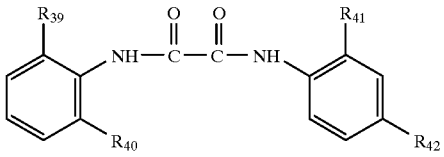

in which $R_{39}$ is $C_1$–$C_4$alkoxy, $R_{41}$ is $C_1$–$C_4$alkyl, $C_1$–$C_4$alkyl-$SO_3M$ or $C_1$–$C_4$alkoxy-$SO_3M$ in which M is H, Na, Li, K, Ca, Mg, ammonium, or ammonium that is mono-, di-, tri- or tetra-substituted by $C_1$–$C_4$alkyl, $C_1$–$C_4$hydroxyalkyl or a mixture thereof, preferably Na, Li or K, and $R_{40}$ and $R_{42}$ are the same and each is hydrogen, tert. butyl or $SO_3M$, in which M is as defined for $R_{41}$.

* * * * *